US005213395A

United States Patent [19]

Korteweg et al.

[11] Patent Number: 5,213,395

[45] Date of Patent: May 25, 1993

[54] ADJUSTABLE SEATING ASSEMBLY

[76] Inventors: Arie J. Korteweg, 15 Wilson Concourse, Croydon, Victoria 3136; Robin Birchall, 7 Brambleberry Lane, Chirnside Park, Victoria 3116, both of Australia

[21] Appl. No.: 679,051

[22] PCT Filed: Sep. 12, 1990

[86] PCT No.: PCT/AU90/00412

§ 371 Date: May 9, 1991

§ 102(e) Date: May 9, 1991

[87] PCT Pub. No.: WO91/03968

PCT Pub. Date: Apr. 4, 1991

[30] Foreign Application Priority Data

Sep. 12, 1989 [AU] Australia ..... PJ6302

[51] Int. Cl.[5] ..... A47C 1/022

[52] U.S. Cl. ..... 297/328; 297/345; 297/408; 297/411; 297/439

[58] Field of Search ..... 297/328, 115, 117, 284 A, 297/284 B, 316, 323, 326, 345, 354, 360, 406, 407, 408, 410, 417, 419, 422, 411, 327, 302, 439

[56] References Cited

U.S. PATENT DOCUMENTS

| | | | |
|---|---|---|---|
| 4,046,419 | 9/1977 | Schmitt | 297/328 X |
| 4,545,614 | 10/1985 | Abu-Isa et al. | 297/284 A |
| 4,657,305 | 4/1987 | Meiller | 297/417 |

FOREIGN PATENT DOCUMENTS

| | | | |
|---|---|---|---|
| 894361 | 7/1949 | Fed. Rep. of Germany | 297/328 |
| 3016839 | 11/1981 | Fed. Rep. of Germany . | |
| 3413821 | 10/1985 | Fed. Rep. of Germany . | |
| 3534131 | 4/1987 | Fed. Rep. of Germany . | |
| 3725462 | 2/1989 | Fed. Rep. of Germany . | |
| 518062 | 2/1940 | United Kingdom | 297/328 |

*Primary Examiner*—Peter R. Brown

*Attorney, Agent, or Firm*—Renner, Otto, Boisselle & Sklar

[57] ABSTRACT

An adjustable seating assembly made up of a seating or load-bearing support (2), a back-rest (3), head-rest (5), arm-rest members (4, 4A) and a ground-engaging or support structure (1), all interconnected in such a manner as to allow for selective adjustment of each member in a progressive manner whereby to have the assembly capable of adopting a variety of different in-use configurations so as to satisfy different requirements of users thereof. A foot-rest is also included which is adjustable both angularly (tiltably) and vertically relative to the ground or the like surface.

14 Claims, 6 Drawing Sheets

ADJUSTABLE SEATING ASSEMBLY

The present invention relates, in general terms, to improvements in adjustable seating means. More particularly, but not exclusively, the invention relates to an improved form of chair assembly which lends itself to ready adjustability in a variety of ways or modes to suit the needs of different users. As such the chair assembly in accordance with the present invention lends itself to usage in a variety of contexts, as for example in commercial offices and the like, and on the domestic scene. For ease of explanation, however, hereinafter reference will be made to an especially preferred usage, namely on the domestic front. It should be realised, however, that the present invention is not to be considered to be in any way limited to such usage. Indeed, the chair assembly in accordance with the present invention is eminently suited to use in a variety of professional contexts, for example in dentist's and doctor's surgeries by chiropractors and the like.

BACKGROUND OF THE INVENTION

Chiropractic experience and medical evidence has shown that the actual physical posture adopted by a person, when either seated or standing, can have a significant influence on the overall comfort, and ultimately the health, of that person. Correct posture, when either standing or seated, will minimise the likelihood of onset of complaints associated with incorrect posture, as for example muscular soreness and tension, etc. In turn, and especially in a work environment, output can be expected to be improved, or at worst more easily maintained at a desired level.

In the past numerous attempts have been made to provide a seating arrangement or chair assembly, in particular, which lends itself to ready adjustability to suit the requirements of any particular user. Almost invariably, however, such prior art arrangements have suffered from the disadvantage in that the degree of adjustability provided is limited and, more importantly, the types of adjustment or adjustability afforded have been even further restricted. In the result the prior art arrangements in general made scant provision for the differing physical or physiological dimensions of all possible or potential users and did not afford adjustability to suit all possible requirements.

By way of further explanation of the above, in any seating arrangement the actual posture adopted by the user is dependent to a significant extent first of all on the physical or physiological requirements of the user, and secondly on the personal whims of such user. To cater for all potential situations it would be necessary to provide for ready adjustment of such parameters as:

(i) the angle to the vertical of what might be termed the back-rest portion or member of the chair assembly;
(ii) the angle of the preponderant horizontal seat portion or member;
(iii) the height of the arm-rests above the seat portion or member;
(iv) the height of the seat portion or member above ground level, to cater for different leg-lengths or preferred knee lengths;
(v) lumbar support or contour adjustment in the back-rest portion or member to cater for different body lengths and shapes;

(vi) both horizontal and vertical adjustments of a head rest to cater for different body shapes and usage requirements; and
(vii) the front-to-back dimension of the seat or in other words the seat depth.

Prior art arrangements have not allowed for adjustment of all the aforementioned parameters.

SUMMARY OF THE INVENTION

It is therefore an object of the present invention to provide a chair assembly or arrangement which in itself allows for ready adjustability of all the aforementioned parameters, whereby to cater for the varying requirements of individual users. In such a way an assembly or arrangement can be arrived at which is adapted for in effect universal usage, regardless of the physical or physiological dimensions or the personal whims or requirements of the user.

The invention provides an adjustable seat assembly including a seat; a back-rest pivotally attached to the seat; a head-rest associated with the back-rest and disposed at the upper-most end thereof; arm-rest members disposed on each side of the seat; and a ground-engaging or support assembly connected with the seat. The seat, back-rest, head-rest, arm-rest members and support assembly are all moveable relative to one another whereby to allow the seat assembly to be continuously and selectively adjustable into and between a plurality of operating or in-use configurations to suit different physical and/or physiological requirements of the user. The ground-engaging or support assembly is in the form of a substantially U-shaped arrangement adapted, in use, to be disposed on a suitable load-supporting surface, and to be pivotally connected to a further substantially H-shaped arrangement adapted to extend substantially upwardly therefrom. The substantially H-shaped arrangement is adapted to receive and retain the seat and associated arm-rest members.

In accordance with a preferred object of the invention there is to be provided a form of adjustable footrest assembly, for use with such a chair, again designed or intended to add to overall comfort and to be adjustable to suit differing use requirements.

In order that the invention may be more clearly understood and put into practical effect there shall now be described in detail a preferred embodiment of a chair assembly in accordance with the invention. The ensuing description is given by way of non-limitative example only and is with reference to the accompanying drawings wherein:

DETAILED DESCRIPTION

Figure 1:
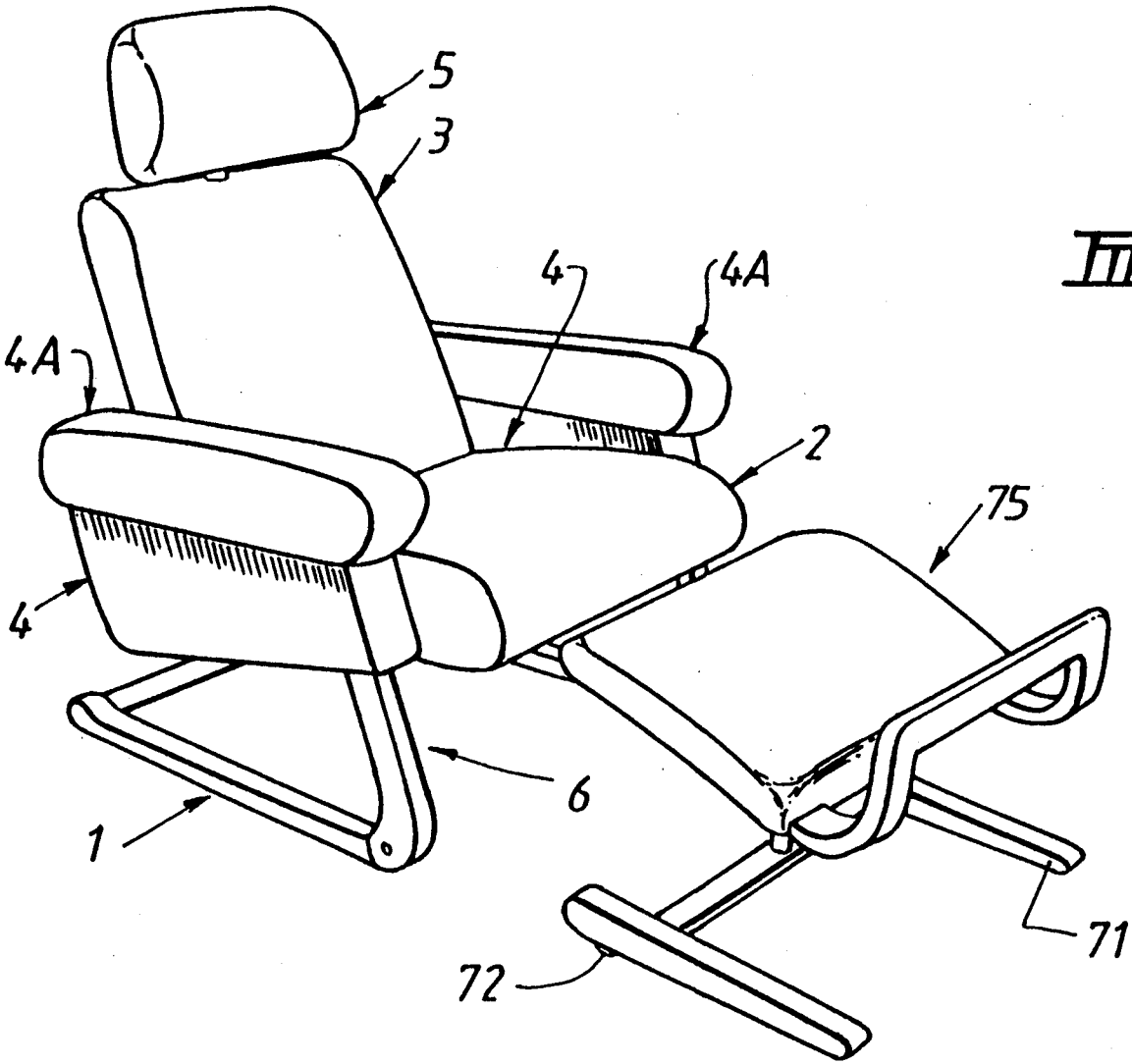
FIG. 1 is a perspective view of a preferred embodiment of a chair assembly in accordance with the present invention, in association with a foot-rest.

As illustrated in FIG. 1 a chair assembly in accordance with the present invention includes, as its principal components, a base or ground-engaging means 1, a seat portion or member 2 and a back-rest portion or member 3. The seat member 2 has, on each opposed upper side thereof, a side member 4 with an arm rest member 4A superimposed thereon. The back-rest member 3 has, protruding from the uppermost end thereof, a head-rest member 5. A support means, generally designated 6, extends between the base or ground-engaging means 1 and the seat member 2.

Figure 10:
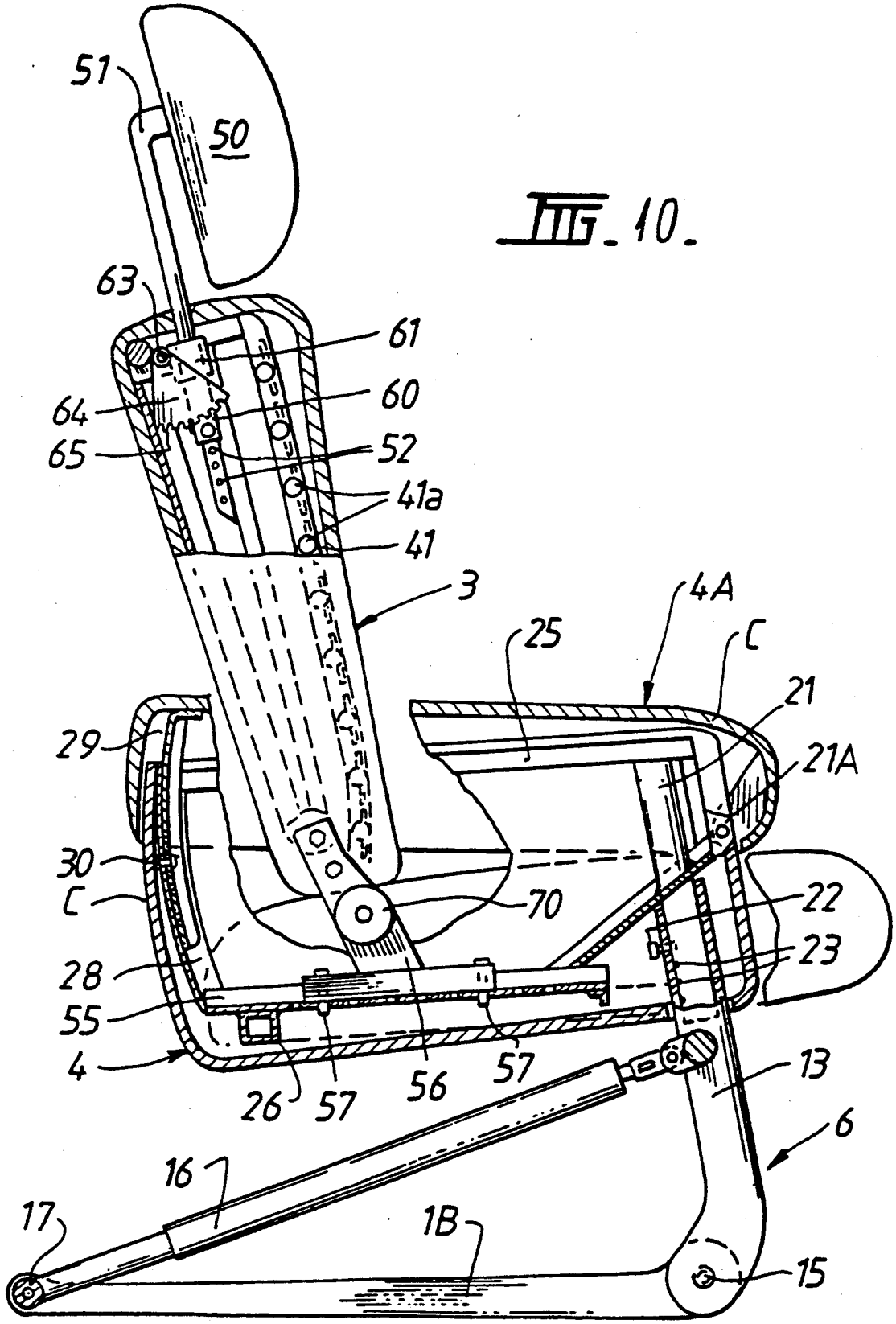
FIG. 10 is a side elevational view of a chair assembly in accordance with the present invention, showing in more detail the various internal components therefor responsible for the adjustability.
Figure 11:
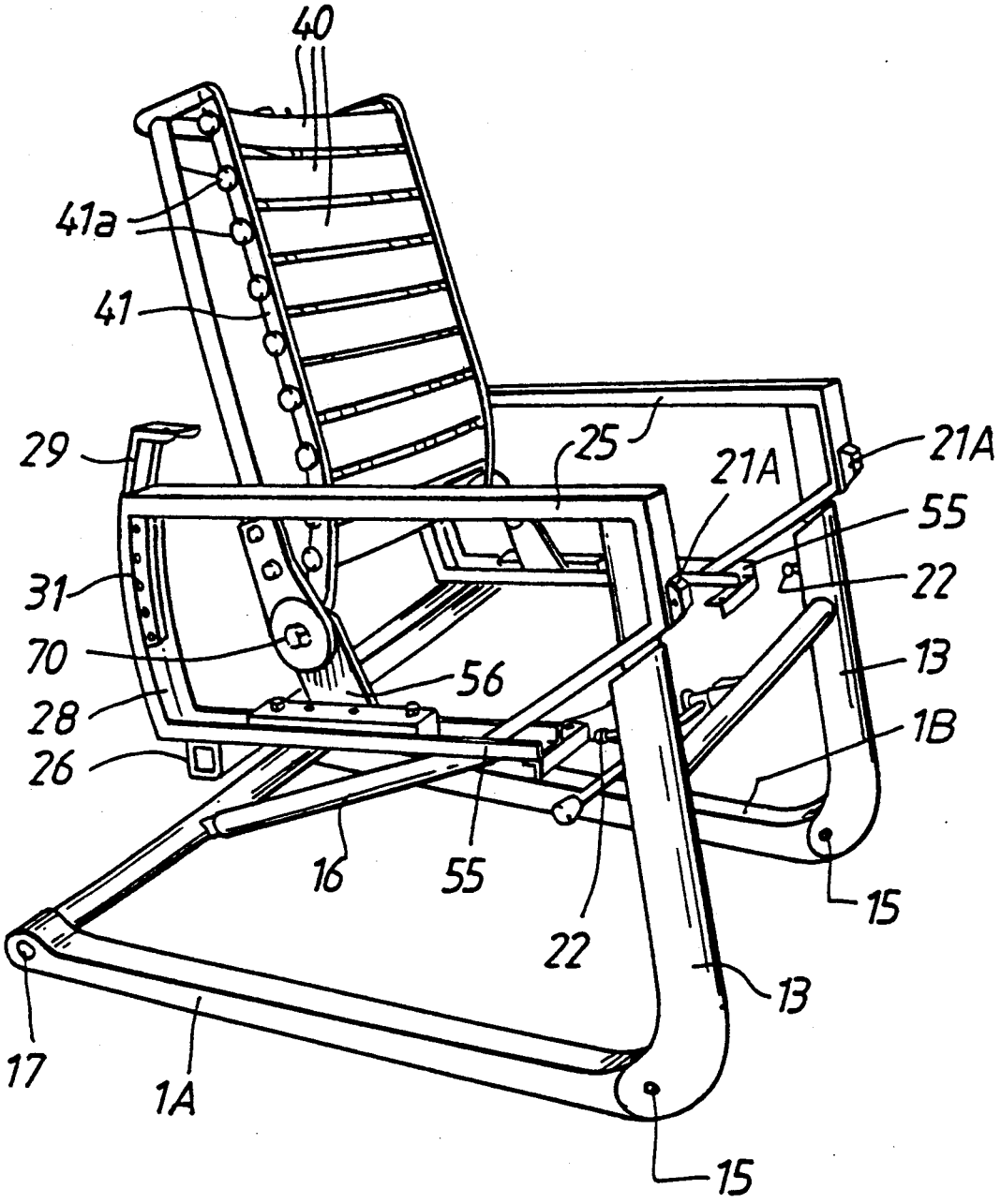
FIG. 11 is a perspective view of a basic chair frame in accordance with the invention, again showing the various internal components without overlying cushioning and covering material.
Figure 12:
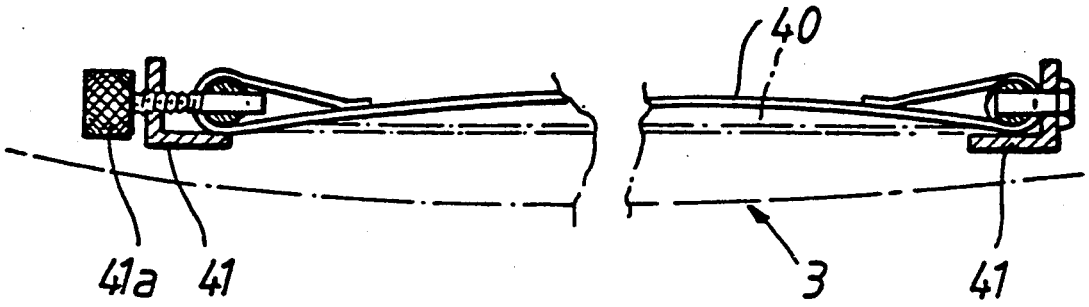
FIG. 12 is a view taken along the line 12—12 of FIG. 11.

Turning now to FIGS. 10 and 11 there is illustrated therein an especially preferred embodiment of a base or ground-engaging means 1 and associated support means 6 in accordance with the invention. As explained hereinafter in more detail the arrangement is such as to allow for ready adjustment of the angular position of the overall seat member 2 relative to the ground and the ground-engaging means 1. There are also incorporated means allowing for adjustment of the overall height of the seat member 2 above or relative to the ground.

The ground-engaging means 1 can be seen, as illustrated more clearly in FIG. 11, to consist of a substantially U-shaped assembly 1 to be disposed on the ground or load-bearing surface, as for example the floor of a building or the like. In the preferred embodiment illustrated the ground engaging means is made up of two longitudinally-extending members 1A, 1B and an end lateral member 1C, adapted to be interconnected in any known manner. In the arrangement as illustrated the end lateral member 1C is of a size and shape as to be, at its ends, disposed internally of end portions 1D of members 1A and 1B respectively, whereby to be fixed relative thereto. In an alternative embodiment, not shown, the ground-engaging means can be in the form of an integral U-shaped member, rather than three separate, interconnected members as illustrated.

The U-shaped member 1 can be constructed of any suitable material, but in an especially preferred embodiment will be constructed of a suitable metallic material and be of hollow, tubular form. It should be realised, however, that the principal requirement is that it must be capable of supporting foreseeable loads to be disposed on the overall chair assembly, and could therefore be constructed from any suitable load-bearing material, for example plastics material.

Adapted, in use, to extend angularly upwardly from a first end of the base or ground-engaging U-shaped member 1 is the support means 6, preferably in the form of a substantially H-shaped assembly consisting of side members 13 and a cross-member 14. The support means 6 is adapted to be pivotally connected to the free ends of the U-shaped ground-engaging member 1 in any suitable manner, as for example by pinning at 15, whereby to be pivotably angularly movable relative thereto. At the other end of the support means 6 there are provided means for co-operation with the seat member 2 of the overall chair assembly, such means to be described in more detail later in this specification.

Figures 2, 3, 4, 5, 6, 7, 8, 9:
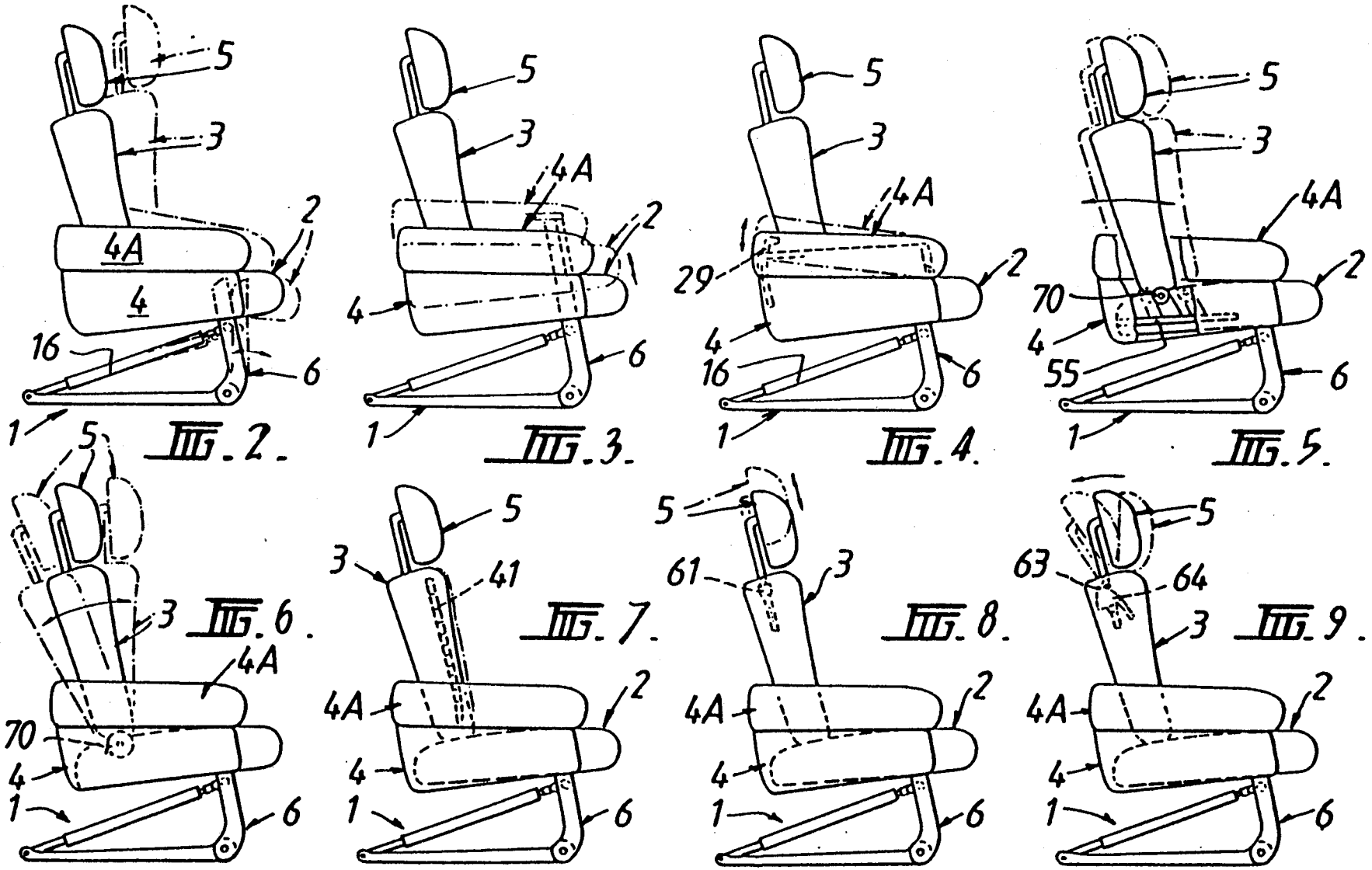
FIGS. 2 to 9 are side elevational views of the chair assembly of FIG. 1, illustrating in phantom the various available modes or types of adjustability for the components of the overall assembly, including composite seat and backrest (FIG. 2), seat alone (FIG. 3), arm-rest (FIG. 4), backrest longitudinal adjustment (FIG. 5), backrest pivotal adjustment (FIG. 6), head-rest vertical adjustment (FIG. 8) and head-rest pivotal adjustment (FIG. 9)

In the preferred embodiment illustrated angular adjustment or adjustability between the means 1 and 6 is achieved by operation of a so-called screw jack or gas-actuated pneumatic or hydraulic piston-cylinder arrangement 16 adapted to extend between those means 1 and 6, with the respective ends of such screw-jack or piston-cylinder arrangement 16 being mounted on the associated means 1 and 6 in any suitable manner, as for example by means of mounting brackets or collars 17 as illustrated. The arrangement is such that operation of the screw jack or piston-cylinder arrangement 16, by any suitable means, functions to vary the relative angular disposition of the means 1 and 6. Since the support means 6 is operatively connected to the seat member 2 of the overall chair assembly, this results in the angle to the vertical, or horizontal, of the seat member 2 being adjustable to suit particular requirements of any particular user, as illustrated in phantom in FIGS. 2 and 3, for example.

The chair or seat member 2, as illustrated for example in FIGS. 10 and 11, includes a main frame, preferably made up from a plurality of channel-shaped members of any desired length, etc. adapted to be interconnected in any known manner, as for example by pinning, welding or the like. As shown in FIG. 10, in particular, suitable padding or cushioning means, generally designated C, can be disposed on the frame. As shown in FIGS. 10 and 11 the arrangement includes means to constitute the arm-rest members 4A, adapted to be pivotally movable in relation to the seat member 2 in a manner to be described hereinafter.

In the preferred embodiment illustrated the support means 6 is constructed of hollow tubular elements, with the uppermost ends of the side members 13 thereof being adapted to co-operate with and receive, in a substantially telescoping manner, complementary-shaped projecting members 21 of the seat member 2 extending downwardly from side-walls 4 of the seat member 2, thereby allowing for relative interconnection therebetween. The degree of penetration of the complementary-shaped members 21 of the seat member 2 into the side members 13 of the support means 6 can be varied by interaction between adjustment bolts 22 provided in each side member 13 and complementary-shaped apertures 23 provided in members 21. In this manner the actual height of the seat member 2 above the base or ground-engaging means 1 can be adjusted in a finite manner whereby to cater for different leg lengths in users of the chair assembly, as illustrated in phantom in FIG. 3.

Turning again to FIGS. 10 and 11, there is illustrated therein the main frame of the seat member 2, that main frame including respective sidewall members 25 interconnected at the rear by a cross-member 26 and having, at the other end thereof, the aforementioned downwardly protruding members 21 adapted to co-operate with the support means 6 of the base assembly 1 in the aforesaid manner. The arrangement as illustrated includes means for mounting a load-supporting assembly therein, in conjunction with a suitable cushioning means. This may be achieved in any suitable manner, and does not constitute part of the invention. In an especially preferred embodiment, however, an array of support members of any given type may be disposed laterally of the seat member 2.

The arrangement as illustrated in FIGS. 10 and 11 also includes means for the location thereon of arm-rest members 4A. To be more specific, each side-wall member 25 of the main frame includes a channel-shaped element 28 therein adapted to receive a complementary-shaped upwardly projecting member 29 provided on the arm rest member 4A. Here again the degree of penetration of the projecting members 29 from the arm-rest members 4A into the arm-rest openings 28 can be varied, whereby to allow for adjustment of the height of the arm-rest members 4A above the seat member 2. In the preferred embodiment illustrated the spatial position of the member 29 can be adjusted through selective interaction between a pin or the like member 30 adapted to extend through the rear portion of arm-rest member 4A and a plurality of correspondingly-shaped apertures 31 provided in the member 29 itself. The arm-rest member 4A then pivots about a hinge point 21A.

Again with reference to FIGS. 10 and 11, there is illustrated therein a frame assembly to be located relative to the main frame whereby to give rise to the overall seating means, including the back-rest portion 3. As illustrated the frame assembly can be constructed of a lattice-work of straps 40, preferably of nylon webbing or the like material, to be disposed laterally of the back-rest frame and seat frame in any suitable manner, as for example by the utilization of mounting brackets 41 adapted to co-operate with complementary members provided internally of the frame members. The frame created by the lattice-work of straps 40 provides a surface for receiving and retaining thereon a suitable cushioning means, not to mention a preferred means for adjustment of the back-rest portion 3 of the overall chair assembly.

In the arrangement as illustrated channel members, generally designated 55, are adapted to make up the lower-most longitudinally extending arm of the respective side frames 25. Those channel members 55 have a plurality of apertures or adjusting holes (not shown) disposed along the surface thereof. The back-rest member 3 is movably connected to the seat member 2 per medium of a plate-like member or mounting bracket 56 adapted to be located within the channel member 55 as illustrated. A plurality of downwardly-extending bolts or pin members 57 are associated with said plate-like member 56. In use the actual position of the back-rest member 3 relative to the seat member 2 can be adjusted horizontally as illustrated, by location of the bolts or pins 57 within the appropriate aperture.

The angular inclination of the back-rest member 3 relative to the seat member 2 can be adjusted or varied by operation of the back-rest pivotting member or recliner mechanism 70, as again illustrated in FIGS. 10 and 11.

In accordance with a preferred embodiment (not shown), the back-rest member 3 can be constructed from an overall frame having a plurality of adjusting straps disposed laterally thereof. Those straps are each preferably constructed in the form of a longitudinally extending strip having loops (closed) located at each end, said loops allowing for location of the overall strap within the frame on suitable vertically extending members (not shown). In the preferred embodiment illustrated the overall contour provided for the back-rest member 3 can be adjusted to suit differing requirements by means of contour adjustment screws 41*a*.

Figure 13:
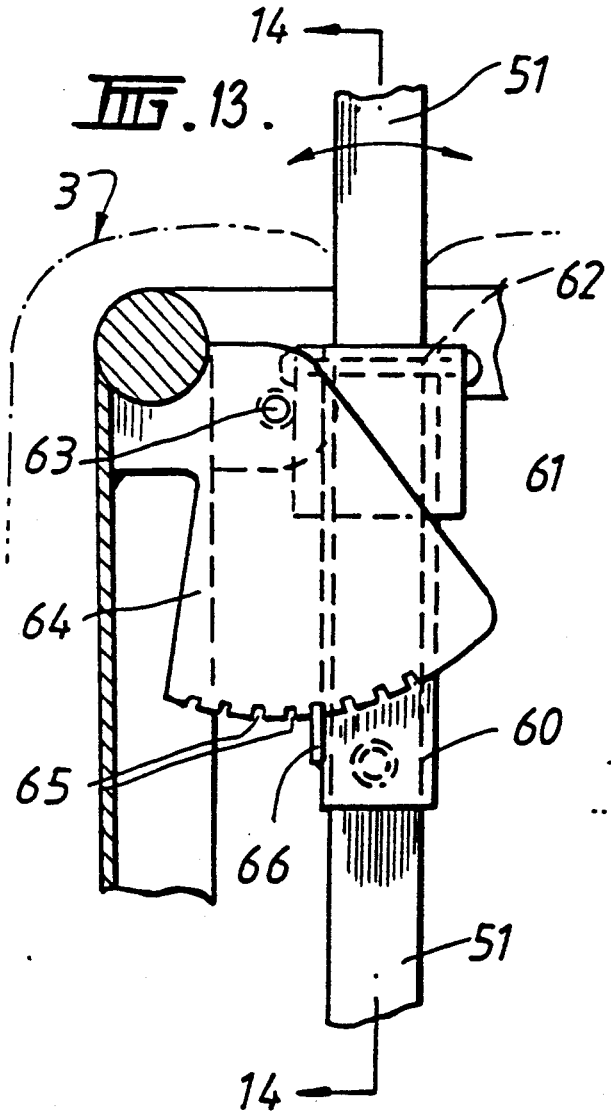
FIG. 13 is a sectional view of a means employed in accordance with the invention allowing for adjustment, both vertically and horizontally, of a head-rest mechanism or portion of an overall chair assembly.
Figure 14:
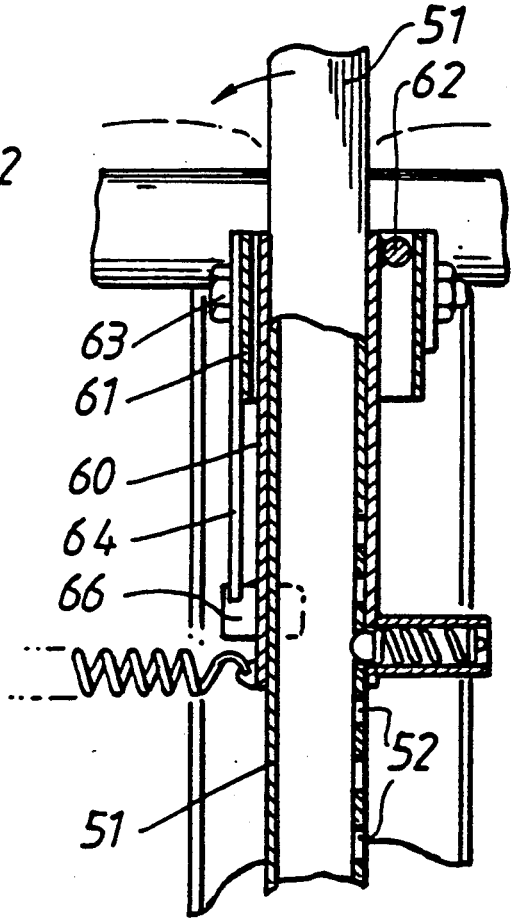
FIG. 14 is a view taken along the line 14—14 of FIG. 13.

In FIGS. 10, 13 and 14 there is shown a preferred embodiment of an adjustable headrest mechanism for use in a chair assembly in accordance with the invention. Such a headrest mechanism is capable of adjustment in two ways. Firstly, the actual height thereof above the chair backrest can be adjusted to suit the needs of different users; and secondly in effect horizontal adjustment relative to the chair backrest is possible.

The arrangement as illustrated is adapted to be fixedly located, in any known manner, relative to the chair backrest frame. The means for such fixing, however, forms no part of the invention.

In general terms the head-rest in accordance with the invention includes a head-receiving member 50, preferably in the form of a contoured member of a suitable cushioning material, having a supporting arm member 51 extending therefrom and adapted to be received within the back-rest frame in a manner to be described in more detail hereinafter. The arm member 51 includes, towards the lowermost end thereof, a plurality of vertically spaced-apart apertures 52 co-operable with a complementary-shaped fixing member such as a spring hall mechanism whereby to allow for adjustment of the vertical height of the contoured member 50 relative to the back-rest frame.

The fixing assembly within the back-rest frame, as illustrated, includes respective inner and outer substantially tubular members 60 and 61, with the inner tubular member 60 being adapted to receive and releasably and adjustably retain therewithin the supporting arm member 51. The inner tubular member 60 is adapted to be pivotally movable laterally within the outer tubular member, about a pivot pin 62. The outer tubular member 61 has associated therewith, and pivotable relative thereto via a pivot pin 63, a so-called quadrant plate 64 having a plurality of teeth 65 thereon. At the lower end of the inner tubular member 60 there is provided a detent means or latching member 66 co-operable with the quadrant plate 64 in the manner as illustrated, for example, in FIG. 13. The arrangement is such that pivotal movement of the inner tubular member 60 brings the quadrant plate 64 out of contact with the detent means 66, thereby allowing for ready front to back adjustment of the angular position of the overall headrest 50.

Figure 15:
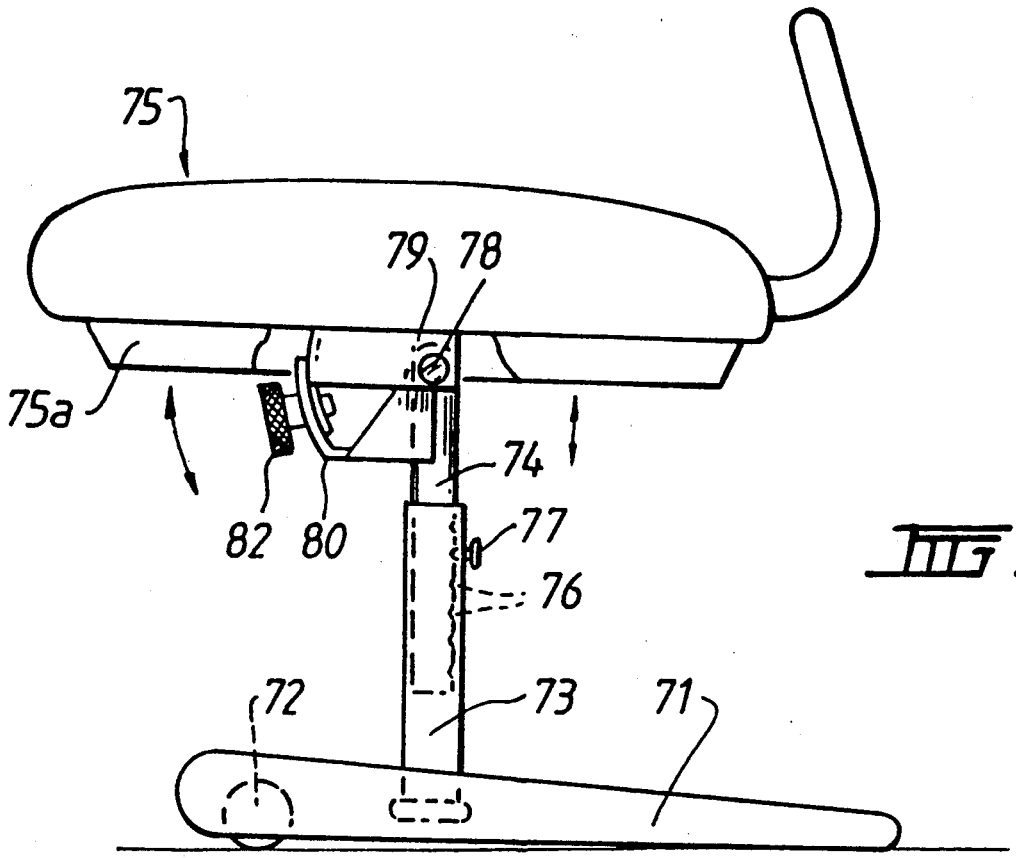
FIG. 15 is a side elevational view of a preferred embodiment of a foot stool or foot rest for use with a chair assembly in accordance with the present invention.

As an accessory to the aforementioned seat assembly there may be provided a foot-stool assembly, generally designated 7, as illustrated more particularly in FIG. 15. The foot stool assembly 7 as illustrated therein includes a ground-engaging member or stool base 71 of any known type, preferably located on castors or the like 72 whereby to allow for ready portability or movability thereof. The ground-engaging member 71 has a shaft or the like member 73 protruding normally therefrom, said shaft 73 being adapted in use to co-operate with a complementary-shaped member 74 protruding downwardly from a foot-rest portion generally designated as 75. The shaft 74 includes a plurality of holes 76 therein adapted, in use, to cooperate with a pin, bolt or the like member 77 extending through the complementary-shaped member 74 of the foot rest portion 75. In such a way the height or disposition of the foot-rest portion 75 above the ground-engaging member 71 can be altered to suit differing personal requirements.

As illustrated, for example, in FIG. 15, the foot-rest portion 75 is also adapted to be angularly adjustable relative to the ground-engaging member 71. As illustrated the foot-rest member 75 includes a main peripheral frame 75*a* of any suitable shape. The member 74 has a tubular member 78 fixedly secured at the uppermost end thereof and extending normally thereof, substantially laterally of the foot-rest portion 75. The main frame then includes collar-like members 79 extending inwardly from each side thereof, said collar-like members 79 being adapted to releasably and rotatably cooperate with the tubular member 78, thereby allowing for pivotal movement of the overall foot-rest member 75 relative to the member 74. Each collar-like member 79 has an angle-adjusting plate 80 extending downwardly therefrom. The member 74 includes mounting brackets at the upper end thereof, with an appropriate adjusting slot or the like means provided therein. The arrangement is such that a pin or the like member 82 disposed through the aperture of the angle-adjusting plates 80 and the brackets will fix the foot-rest portion 75 in any desired position. Adjustment of that position can be secured by movement of the pin 82 within the adjusting slot.

The foot-rest preferably has associated therewith, and attached thereto in any known manner, a heel-locating bar generally designated as 83. Such bar 83 functions to prevent unwanted movement of the overall foot-rest in a direction towards the chair itself, when set at the proper angle so as to be engaged by or in contact with the heel(s) of the person seated in the chair. Preferably this bar 83 will be pivotally movable relative to the foot-rest portion 75.

To provide improved comfort a suitable cushioning means C, of any known type, may be disposed on the foot-rest portion 75.

The arrangement as described and illustrated can be seen to be capable of being adjusted in a variety of ways to suit differing physical, physiological or other requirements of the user. To be more specific, and as illustrated in FIGS. 2 to 9, progressive and selective adjustment of the overall configuration is possible.

This capability serves to set the arrangement the subject of the present application apart from the prior art arrangements, now of which afford the same degree of flexibility or adjustability.

Finally, it is to be understood that the aforegoing description refers merely to preferred embodiments of the invention, and that variations and modifications will be possible thereto without departing from the spirit and scope of the invention, the ambit of which is to be determined from the following claims.

What is claimed is:

1. An adjustable seat assembly including: a seat; a back-rest pivotally attached to said seat; a head-rest associated with said back-rest and disposed at the upper-most end thereof; arm-rest members disposed on each side of said seat; and a support assembly connected with said seat, said seat, back-rest, head-rest, arm-rest members and support assembly all being mounted with respect to one another for relative movement with respect to one another to allow the seat assembly to be selectively adjustable into and between a plurality of configurations to suit different physical and/or physiological requirements of the user, and said support assembly including a substantially U-shaped member adapted, in use, to be disposed on a suitable load-supporting surface, and a substantially H-shaped member receiving and retaining said seat and associated arm-rest members, said H-shaped member having the ends of the lower legs thereof pivotally connected to the ends of the legs of said U-shaped member.

2. The assembly as claimed in claim 1, including means for adjusting the relative angular disposition of said U-shaped and H-shaped members, said means for adjusting including a screw-jack or a gas actuated, pneumatic or hydraulic piston-cylinder arrangement operably connected between said U-shaped and H-shaped members.

3. The assembly as claimed in claim 2, including means for connecting said arm-rest members at one end to a free end of said H-shaped member for upward and downward movement of said arm-rest members relative to said H-shaped member.

4. The assembly as claimed in claim 3, wherein both said U-shaped and H-shaped members are constructed from a plurality of substantially hollow tubular elements, said elements being pivotally interconnected, as by pinning or the like means.

5. The assembly as claimed in claim 4, wherein said seat has at each side thereof a framework including a substantially vertically disposed channel shaped element, said arm-rest members each include a downwardly protruding member disposed for vertical movement within said substantially vertically disposed channel-shaped element of a corresponding said framework so as to be selectively vertically adjustable therewithin, and wherein said selective vertical adjustment is achieved by location of a pin member within a selected one of plurality of complementary-shaped apertures.

6. The assembly as claimed in claim 5, wherein said back-rest is in the form of a substantially parallelepipedal-shaped framework having a plurality of adjusting straps disposed laterally thereof, the tension in said straps being selectively adjustable whereby to allow for variation of the overall contour of said back-rest framework whereby to suit different back-and-lumbar-support requirements of the user.

7. The assembly as claimed in claim 6, wherein said straps are each constructed of a substantially inelastic material.

8. The assembly as claimed in claim 7, wherein said seat, back-rest, head-rest and arm-rest members are each formed of a metallic material and have disposed thereon cushioning and/or upholstery material.

9. The assembly as claimed in claim 8, wherein said head-rest is in the form of a contoured member having extending downwardly therefrom a supporting arm member, and said back-rest includes a complementary-shaped hollow member disposed centrally thereof, said supporting arm member being vertically adjustably retained within said hollow member so as to allow for adjustment of the vertical distance between said contoured member of said head-rest and said back-rest.

10. The assembly as claimed in claim 9, wherein said back-rest includes a toothed plate member, and inner and outer substantially tubular elements, said inner element forming said hollow member in which said supporting arm member of said head-rest is vertically adjustably retained, means for mounting said inner element for lateral movement relative to said outer element, and means for mounting said outer element for pivotal movement relative to said toothed plate member about a laterally extending axis for forward and rearward adjustment of said head-rest relative to said back-rest, said inner tubular element having detent means for cooperating with the teeth of said toothed plate member so as to prevent forward or backward movement of said head-rest relative to said back-rest, and said inner tubular element being movable laterally relative to said outer element for disengaging said detent means with respect to said plate member to permit forward or rearward adjustment of said head-rest relative to said back-rest.

11. The assembly as claimed in claim 10, having a horizontally movable and vertically adjustable foot-rest assembly associated therewith, said foot-rest assembly including a ground-engaging means, a foot-support spaced vertically therefrom, and means for mounting said foot-support for selective tilting relative to said ground-engaging means.

12. The assembly as claimed in claim 11, wherein said ground-engaging means of said foot-rest assembly includes an upwardly extending shaft-like element in telescoping relationship with a downwardly-extending member dependent from said foot-support, and the vertical position of said foot-support relative to said ground-engaging means of said foot-rest assembly being adjustable by interaction between a pin or the like protrusion provided on one of said shaft-like element and said downwardly-extending member and any one of a plurality of apertures provided in or through the other of said shaft-like element and said downwardly-extending member.

13. The assembly as claimed in claim 12, wherein said foot-rest assembly includes a main peripheral frame of any suitable shape, and wherein said downwardly-extending member has a tubular member fixedly secured at the uppermost end thereof and extending normally therefrom, substantially laterally of said foot-support, said main peripheral frame including collar-like members extending inwardly from each side thereof, said collar-like members being rotatably supported on said tubular member so as to allow for pivotal movement of said foot-support.

14. The assembly as claimed in claim 13, wherein each said collar-like member includes a plate or the like member extending downwardly therefrom, and wherein said downwardly-extending member includes mounting brackets at the upper end thereof, having an adjusting slot or the like means provided therein, the arrangement being such that a pin or the like member disposed through an aperture of said plate or the like member and said brackets fixes said foot-support in any desired position, with adjustment of that position being secured by movement of said pin within said adjusting slot.

* * * * *